US009730279B2

(12) United States Patent
Li et al.

(10) Patent No.: US 9,730,279 B2
(45) Date of Patent: Aug. 8, 2017

(54) ARC-SHAPED MICROWAVE OVEN

(71) Applicant: GUANGDONG GALANZ MICROWAVE OVEN AND ELECTRICAL APPLIANCES MANUFACTURING CO., LTD, Forshan (CN)

(72) Inventors: Zhigang Li, Foshan (CN); Feng Li, Foshan (CN)

(73) Assignee: GUANGDONG GALANZ MICROWAVE OVEN AND ELECTRICAL APPLIANCES MANUFACTURING CO., LTD., Foshan (CN)

( * ) Notice: Subject to any disclaimer, the term of this patent is extended or adjusted under 35 U.S.C. 154(b) by 312 days.

(21) Appl. No.: 14/417,593

(22) PCT Filed: Dec. 26, 2013

(86) PCT No.: PCT/CN2013/090584

§ 371 (c)(1),
(2) Date: Jan. 27, 2015

(87) PCT Pub. No.: WO2014/101800

PCT Pub. Date: Jul. 3, 2014

(65) Prior Publication Data

US 2015/0257208 A1 Sep. 10, 2015

(30) Foreign Application Priority Data

Dec. 31, 2012 (CN) ..... 2012 1 0593608
Dec. 31, 2012 (CN) ..... 2012 1 0594597

(51) Int. Cl.
*H05B 6/80* (2006.01)
*H05B 6/76* (2006.01)
(Continued)

(52) U.S. Cl.
CPC ..... *H05B 6/6402* (2013.01); *H05B 6/6414* (2013.01); *H05B 6/6426* (2013.01);
(Continued)

(58) Field of Classification Search
CPC .. H05B 6/6414; H05B 6/6426; H05B 6/6435; H05B 6/766; H05B 6/687; H05B 6/763; H05B 6/6402
(Continued)

(56) References Cited

U.S. PATENT DOCUMENTS 5,365,918 A * 11/1994 Smith ..... F24C 15/162 126/21 A
6,750,434 B1 * 6/2004 Han ..... H05B 6/6414 126/190
(Continued)

FOREIGN PATENT DOCUMENTS

CN 2898661 5/2007
CN 101225972 7/2008
(Continued)

OTHER PUBLICATIONS

English Translation of PCT Search Report for International Application No. PCT/CN2013/090584; mailed on Mar. 27, 2014.
(Continued)

*Primary Examiner* — Quang Van
(74) *Attorney, Agent, or Firm* — Kagan Binder, PLLC

(57) ABSTRACT

An arc-shaped microwave oven is disclosed, including a cooking cavity, an oven base, a microwave generation unit disposed within the oven base, and a control unit also disposed within the oven base, wherein the oven base includes a bottom portion and a back portion that is assembled with the bottom portion, the cooking cavity is formed by a cavity surrounded by the bottom portion, the back portion and a furnace door, the furnace door is in a
(Continued)

hood shape and provided with a microwave shielding cover, and the microwave generation unit and the control unit are electrically connected to an operation/display unit. The furnace door can be movably connected to the back portion, the furnace door can swing up and down relative to the bottom portion and the back portion to open and close respectively, and the furnace door can be in an arc hood shape.

15 Claims, 4 Drawing Sheets

(51) Int. Cl.
*H05B 6/64* (2006.01)
*H05B 6/68* (2006.01)

(52) U.S. Cl.
CPC ..... *H05B 6/6435* (2013.01); *H05B 6/687* (2013.01); *H05B 6/763* (2013.01); *H05B 6/766* (2013.01)

(58) Field of Classification Search
USPC ..... 219/680, 681, 685, 689, 400, 702, 739, 219/740, 741, 742, 754, 756, 757, 762; 126/21 A, 190, 198, 37 R
See application file for complete search history.

(56) References Cited

U.S. PATENT DOCUMENTS

| | | | | |
|---|---|---|---|---|
| 2003/0168448 | A1 | 9/2003 | Shimizu et al. | |
| 2012/0312809 | A1* | 12/2012 | Wang ..... | H05B 6/6426 219/756 |

FOREIGN PATENT DOCUMENTS

| | | |
|---|---|---|
| CN | 201382462 | 1/2010 |
| CN | 101793414 | 8/2010 |
| CN | 201779744 | 3/2011 |
| CN | 201983305 | 9/2011 |
| CN | 102331008 | 1/2012 |
| CN | 202432562 | 9/2012 |
| CN | 103062809 | 4/2013 |
| CN | 103090428 | 5/2013 |
| CN | 203024204 | 6/2013 |
| CN | 203024209 | 6/2013 |
| CN | 203131892 | 8/2013 |
| GB | 2280829 | 2/1995 |
| JP | 50-21311 | 2/1976 |
| JP | 2003083548 | 3/2003 |
| KR | 20110015783 | 2/2011 |
| WO | 87/01550 | 3/1987 |
| WO | 01/58217 | 8/2001 |
| WO | 2011/103796 | 9/2011 |

OTHER PUBLICATIONS

Search Report & First Office Action for Priority Chinese Patent Application No. 201210594597.8, mailed on Sep. 19, 2014 (Official Copy only).
Second Office Action for Priority Chinese Patent Application No. 201210594597.8, mailed on Mar. 23, 2015 (Official Copy only).
Third Office Action for Priority Chinese Patent Application No. 201210594597.8, mailed on Aug. 17, 2015 (Official Copy only).
Search Report & First Office Action for Priority Chinese Patent Application No. 201210593608.0, mailed on Sep. 3, 2014 (Official Copy only).
Second Office Action for Priority Chinese Patent Application No. 201210593608.0, mailed on Jan. 16, 2015 (Official Copy only).
Office Action (Notice of Grounds for Rejection) for parallel Japanese Patent Application No. 2015-525733 mailed on Dec. 22, 2015 (Official Copy only).
The extended European Search Report for parallel European Patent Application No. 13866700.1, mailed on Mar. 14, 2016 (Official Copy only).

* cited by examiner

ARC-SHAPED MICROWAVE OVEN

This application is a national stage application under 35 U.S.C 371 of International Application No. PCT/CN2013/090584, which was filed on Dec. 26, 2013, which in turn claims priority to Chinese Application No. 201210594597.8, which was filed on Dec. 31, 2012, and Chinese Application No. 201210593608.0, which was filed on Dec. 31, 2012.

FIELD

The present disclosure relates to an arc-shaped microwave oven.

BACKGROUND

For a traditional microwave oven, it generally includes a main body with a structure including a box-shape cooking chamber, a plate-like door body, and an electrical control chamber located adjacent to a side of the cooking chamber, wherein a furnace cavity is wrapped by a metal layer, a magnetron is placed at a side of the furnace cavity, and the magnetron transmits microwave beams from the side of the furnace cavity into the furnace cavity. The microwave oven with the above structure has a low utilization ratio of the cooking chamber due to the limitation of the box shape. And, given that the whole volume of the microwave oven should not be too large, the size of the cooking chamber is often limited. In addition, because the door body is arranged in front of the cooking chamber, it has been inconvenient for placing food into or removing food from the cooking chamber, and cleaning the cooking chamber.

A Chinese patent document with a publication number of CN2898661Y, published on May 9, 2007, has disclosed a microwave oven, which includes a microwave oven case, a window body, a furnace door configured to cover the window body and a handle arranged on the furnace door, wherein the microwave oven case and its inner wall have a semi-spherical shape. Although the microwave oven requires less space, in view of microwave radiation shielding, it increases difficulty in production to apply a plurality of covers. As a consequence, it is necessary to improve the above structure.

A Chinese patent document with a publication number of CN201382462Y, filed by the present applicant and published on Jan. 13, 2010, has disclosed a microwave oven, which includes an oven base, a microwave generation unit and a cooking cavity, wherein the cooking cavity is formed by a cavity surrounded by a support mechanism arranged on the oven base and a microwave shielding cover, the microwave shielding cover can be opened or closed relative to the oven base and/or the support mechanism, the support mechanism comprises an oven cover arranged on the oven base and is in a flat plate shape, a disc shape or a pan shape, and the surface of the oven cover is provided with microwave penetrating holes corresponding to a microwave emitting area. The cooking cavity of the microwave oven is directly formed by the support mechanism for supporting food and the microwave shielding cover, the oven base internally provided with the microwave generation unit is arranged below the cooking cavity, microwaves generated by the microwave generation unit transmit from bottom to top into the cooking cavity to heat the foods inside the cooking cavity, therefore it breaks through the design of the traditional microwave oven. However, the structure cannot achieve multiple ways of microwave transmission, thus, a further work and improvement is needed.

SUMMARY

The objective of the present disclosure is to provide a microwave oven to overcome the deficiencies of the prior art, wherein the microwave oven of the present disclosure has a rational structure, a simple operation process, a low manufacture cost, a high safety, is easy to be cleaned, and can prevent the leakage of microwaves effectively and greatly improve the utilization of the cooking cavity.

According to the objective of the present disclosure, an arc-shaped microwave oven includes a cooking cavity, an oven base, a microwave generation unit disposed within the oven base, and a control unit also disposed within the oven base, wherein, the oven base includes a bottom portion and a back portion that is assembled with the bottom portion, the cooking cavity is formed by a cavity surrounded by the bottom portion, the back portion and a furnace door, the furnace door is in a hood shape and provided with a microwave shielding means, and the microwave generation unit and the control unit are electrically connected to an operation/display unit.

The furnace door can be movably connected to the back portion, the furnace door can swing up and down relative to the bottom portion and the back portion to open and close respectively, and the furnace door can be in an arc hood shape.

The furnace door can include an external cover, a microwave shielding cover, an inner cover and a framework, sequentially arranged from external to internal, wherein the framework includes a first framework component and a second framework component, the first framework component and the second framework component are connected at an angle to each other, the external cover, the microwave shielding cover and the inner cover are assembled together by the framework, and the framework is provided with a choke groove.

The first framework component and the second framework component can be formed integrally or separately, and the first framework component and the second framework component can be U shaped, arch shaped, semi-circular shaped or elliptical shaped.

The inner cover can be provided with a raised edge which can be embedded in an assembling slot of the framework and/or crimping contacts with an assembling edge of the framework so as to connect the inner cover to the framework.

The microwave shielding cover can be provided with flanges. One flange can crimping contact with the first framework component through a first crimp ring, and another flange can crimping contact with the second framework component through a second crimp ring.

The microwave shielding cover can be in a helmet shape and have a cross-section in U shape, arch shape, semi-circular shape or elliptical shape. The external cover and the inner cover have shapes that match the microwave shielding cover. The surface of the microwave shielding cover can be provided with several apertures that are hexagonal.

The external cover can be sleeved on the framework and provided with a view window.

The view window can be provided with a frame which is enchased on the outside of the view window.

The external cover can be connected with a decorative cover which is located behind the external cover. And/or, the external cover can be also connected with a decorative board which is located beneath the external cover.

The decorative cover and/or decorative board are provided with buckles which can be connected with retainers provided on the framework, and the external cover can be clamped and fastened on the framework through the decorative cover and/or decorative board.

The bottom portion can include a bottom cover, and a bottom board horizontally arranged on top of the bottom cover. The back portion can be arranged at the rear end of the bottom portion and include a back cover and a back board, the back board can be vertically positioned on the bottom board, and the back cover can be arranged on the bottom portion and buckled with the back board. Each of the bottom portion and the back portion can be a rectangular with rounded corners, and the furnace door can be in a helmet shape.

The microwave generation unit and the control unit can be arranged inside the bottom portion. Optionally, the microwave generation unit and the control unit can be arranged inside the back portion. Optionally, the microwave generation unit and the control unit can be arranged inside the bottom portion and the back portion respectively.

The operation/display unit can be arranged on one side of the bottom portion, and the operation/display unit can be protruded out of or recessed into the external surface of the bottom portion.

A boss or bulge extended outwards can be provided on the front or two sides of the bottom portion, and the operation/display unit can be provided on a facade of the bottom portion.

A boss or bulge extended outwards can be provided on the front or circumference of the bottom portion, and the operation/display unit can be provided on the boss or bulge. The operation/display unit can be provided on the furnace door.

With the plurality of frameworks which form a L shape in combination with the microwave shielding cover in U shape according to the present disclosure, electromagnetic waves leaking from the furnace door or a gap between the furnace door and the furnace frame can return to the furnace cavity of the microwave oven after reaching the microwave shielding cover, without causing harm to the user, and it can effectively reduce the amount of electromagnetic radiation from the microwave oven to humans.

The cross section of the external cover, whether a transverse section or a longitudinal section, is in a U shape, according to the present disclosure, which can maximize space of the cooking cavity in the microwave oven to improve heating efficiency. The clamp ring including the first clamp ring and the second clamp ring can improve the strength of the microwave shielding cover and also play a role in efficient fixation. With the oil resistance of the inner cover, it is effective to keep the microwave oven clean.

The cooking cavity is mainly formed by a hood shaped furnace door provided with a shielding component, according to the present disclosure, which can ensure the uniformity of microwave used in the cooking cavity to improve the utilization of the cooking cavity and increases the volume of the cooking cavity. The furnace door can swing to open or close, which is convenient to put and fetch the food and enable proper hygiene. The microwave generation unit and control unit are arranged reasonably to make the structure simple and compact, microwaves from the microwave generation unit are controlled to transmit into the cooking cavity from bottom to top or from back to front, and the microwave has a low consumption during transmission.

Meanwhile, the operation/display unit provided on the furnace door or bottom base is easy to manufacture and assemble, and creates a elegant appearance, coordinated with the furnace door or bottom base. Various operating methods can be used to embody the humanized design, such as key manipulation, voice manipulation or touch manipulation, and the key manipulation has a good hand feeling.

In addition, the present disclosure has advantages of simple and reasonable structure, low manufacturing cost, high safety, high thermal efficiency and capable of preventing the leakage of microwaves effectively.

DESCRIPTION OF THE REFERENCE SIGNS

Figure 1:
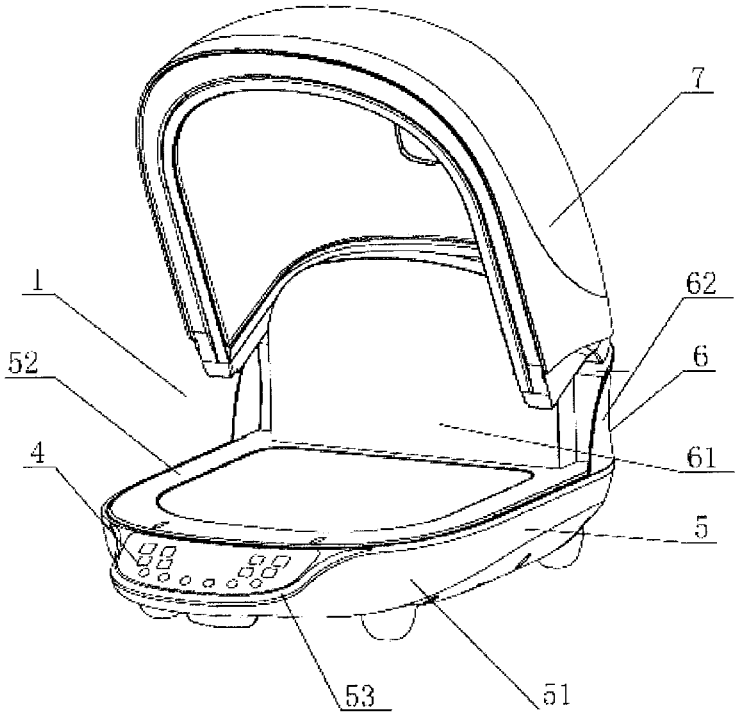
FIG. 1 is a schematic diagram illustrating a three-dimensional structure of an arc-shaped microwave oven according to a first embodiment of the present disclosure.

1 cooking cavity
2 microwave generation unit
3 control unit
4 operation/display unit
5 bottom base
51 bottom cover
52 bottom board
53 boss or bulge
6 back portion
61 back board
62 back cover
7 furnace door
71 external cover
711 view window
72 microwave shielding cover
721, 721' flange
73 inner cover
731, 731' raised edge
74 framework
741 first framework component
742 second framework component
743 assembling slot
744 assembling edge
75 choke groove
771 first crimp ring
772 second crimp ring
78 decorative cover
79 decorative board

DETAILED EMBODIMENTS

The disclosure may be best understood by reference to the following description taken in conjunction with the accompanying drawings.

The First Embodiment

See FIGS. 1 and 4-9. An arc-shaped microwave oven includes a cooking cavity 1, an oven base, a microwave generation unit 2 disposed within the oven base, and a control unit 3 also disposed within the oven base. The oven base includes a bottom portion 5 and a back portion 6 that is assembled with the bottom portion, the cooking cavity 1 is formed by a cavity surrounded by the bottom portion 5, the back portion 6 and a furnace door 7, the furnace door 7 is in a hood shape and provided with a microwave shielding means, and the microwave generation unit 2 and the control unit 3 are electrically connected to an operation/display unit 4.

The furnace door 7 may be movably connected to the back portion 6 that the furnace door 7 may swing up and down relative to the bottom portion 5 and the back portion 6 to open and close respectively, and the furnace door 7 may be in an arc hood shape.

See FIGS. 5-9. The furnace door 7 may include an external cover 71, a microwave shielding cover 72, an inner cover 73 and a framework 74. The external cover 71, the microwave shielding cover 72, the inner cover 73 are assembled together through the framework 74. The framework 74 may be provided with a choke groove 75.

The framework 74 may include a first framework component 741 and a second framework component 742, and the first framework component 741 and the second framework component 742 are connected at an angle to each other. The first framework component 741 and the second framework component 742 may be formed integrally or separately, and the first framework component 741 and the second framework component 742 may be U shaped, arch shaped, semi-circular shaped or elliptical shaped.

The microwave shielding cover 72 may be provided with a flange 721 through which the microwave shielding cover 72 can crimping contact with the framework 74. The inner cover 73 may be provided with a raised edge 731 through which the inner cover 73 may be embedded in the framework 74. The framework 74 may be provided with an assembling slot 743 and/or an assembling edge 744. The raised edge 731 may be embedded in the assembling slot 743 of the framework and/or crimping contacts with the assembling edge 744 of the framework so as to connect the inner cover 73 to the framework 74.

In the embodiment, the assembling slot 743 may arranged on the inside of the framework 74 and the assembling edge 744 may be arranged on the outside of the framework 74, according to the need.

The microwave shielding cover 72 may be in a helmet shape and have a cross-section in U shape, arch shape, semi-circular shape or elliptical shape, that match the cross-section of the inner cover 73. The surface of the microwave shielding cover 72 may be provided with several apertures that are hexagonal.

The microwave shielding cover 72 may be provided with a first crimp ring 771 integrated with the microwave shielding cover 72. The first crimp ring 771 may crimping contact with the flange 721, 721' of the microwave shielding cover 72, the flange 721 may crimping contact with the first framework component 741 through the first crimp ring 771, and the flange 721' may crimping contact with the second framework component 742 through a second crimp ring 772.

The external cover 71 may be sleeved on the framework 74, and the external cover 71 may have a cross-section in U shape. The external cover may be provided with a view window 711. The view window may be provided with a frame 712 which is enchased on the outside of the view window 711.

In the embodiment, the external cover 71 may be connected with a decorative cover 78 which is located behind the external cover 71. And/or, the external cover 71 may be also connected with a decorative board 79 which is located beneath the external cover 71. The decorative cover 78 and/or decorative board 79 are provided with buckles which can be connected with retainers provided on the framework 74, and the external cover 71 can be clamped and fastened on the framework 74 through the decorative cover 78 and/or decorative board 79.

The bottom portion 5 may include a bottom cover 51, and a bottom board 52 horizontally arranged on top of the bottom cover 51. The back portion 6 may be arranged at the rear end of the bottom portion 5 and include a back board 61 and a back cover 62, the back board 61 may be vertically positioned on the bottom board 52, and the back cover 62 may be arranged on the bottom portion 5 and buckled with the back board 61. Each of the bottom portion 5 and the back portion 6 may be a rectangular with rounded corners, and the furnace door 7 may be in a helmet shape.

The microwave generation unit may be arranged inside the back portion 6, and the control unit may be arranged inside the bottom portion 5. A boss or bulge 53 extended outwards may be provided on the front or circumference of the bottom portion 5, and the operation/display unit 4 may be provided on the provided on.

The Second Embodiment

Figure 2:
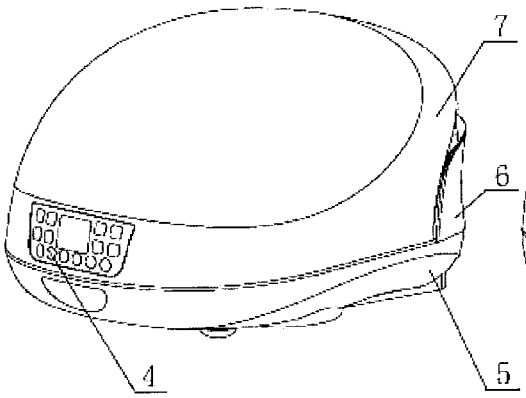
FIG. 2 is a schematic diagram illustrating a three-dimensional structure of an arc-shaped microwave oven according to a second embodiment of the present disclosure.

See FIG. 2, the embodiment is different from the first embodiment that the operation/display unit 4 is provided on the furnace door, others are the same as the first embodiment.

The Third Embodiment

Figure 3:
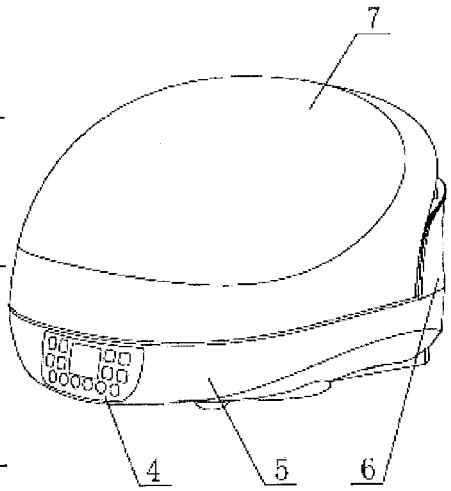
FIG. 3 is a schematic diagram illustrating a three-dimensional structure of an arc-shaped microwave oven according to a third embodiment of the present disclosure.
Figure 4:
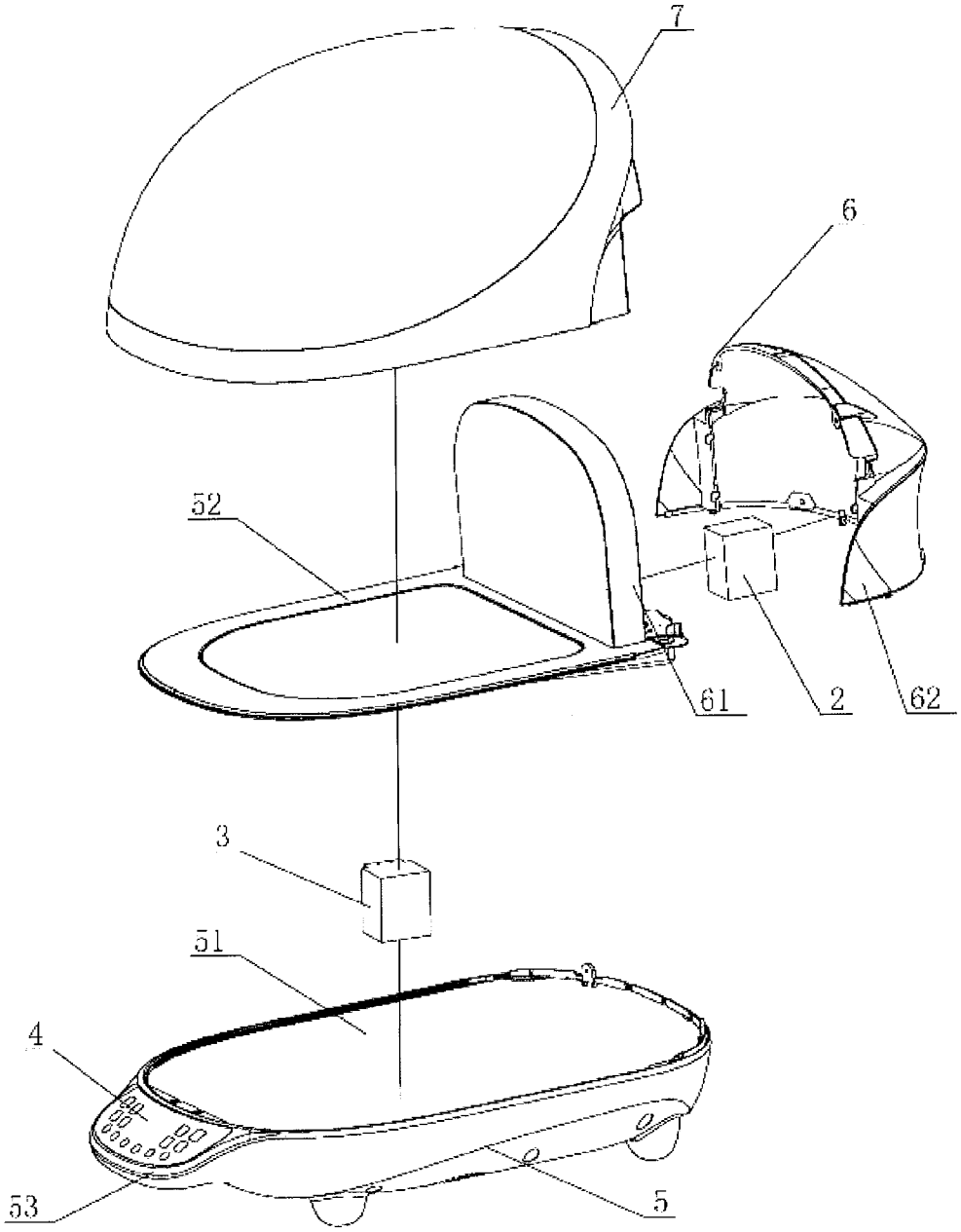
FIG. 4 is a schematic diagram illustrating a breakdown structure of the arc-shaped microwave oven of FIG. 1.
Figure 5:
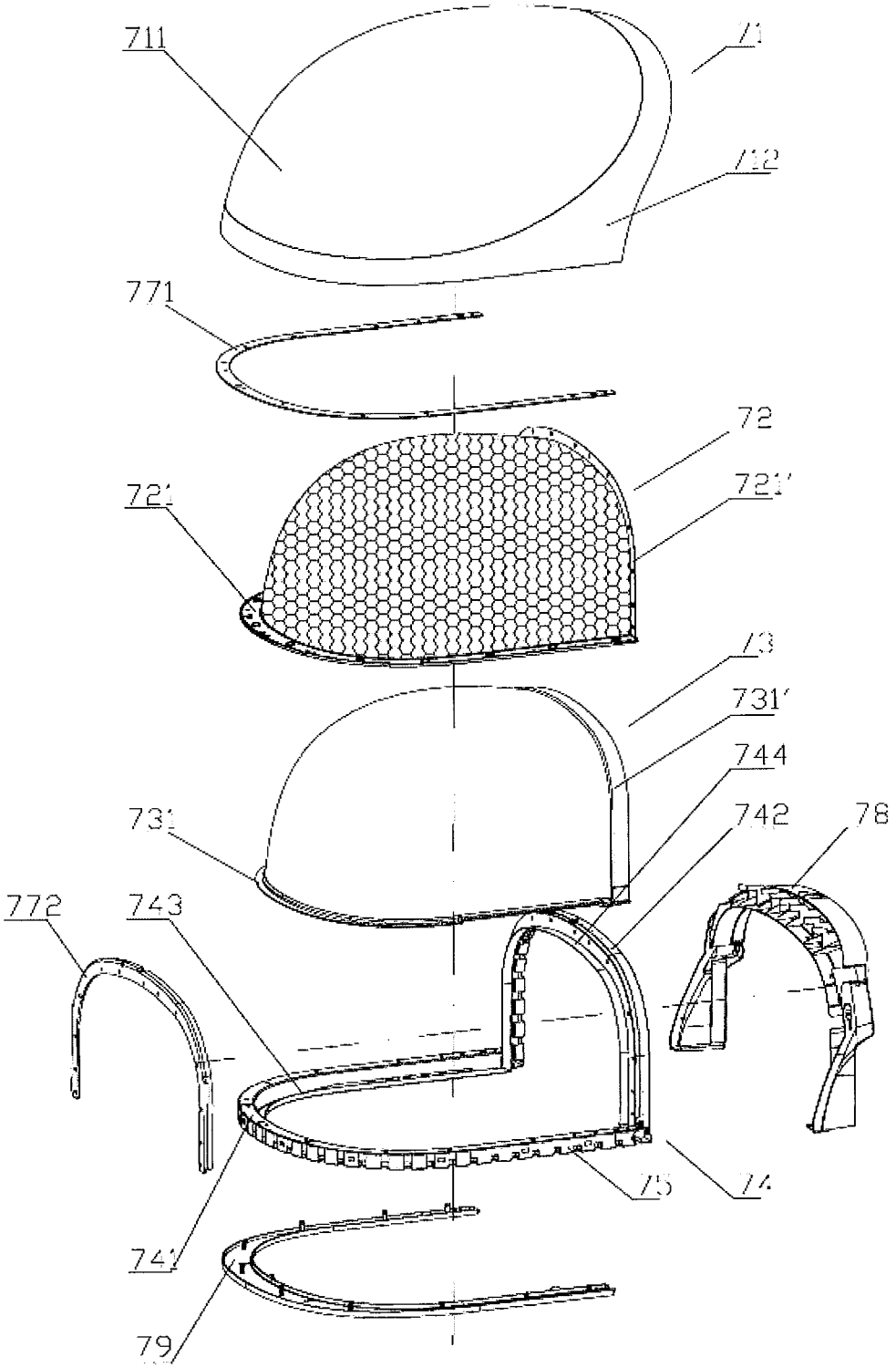
FIG. 5 is an explode diagram illustrating a furnace door according to a first embodiment of the present disclosure.
Figure 6:
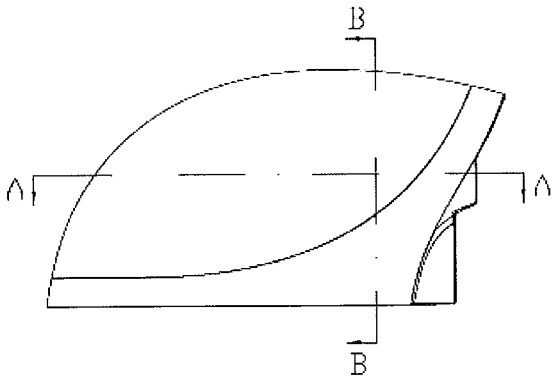
FIG. 6 is a schematic diagram illustrating a furnace door assembled according to a first embodiment of the present disclosure.
Figure 7:
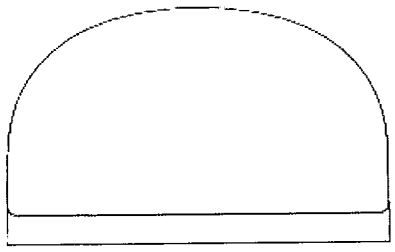
FIG. 7 is a left view of FIG. 6.
Figure 8:
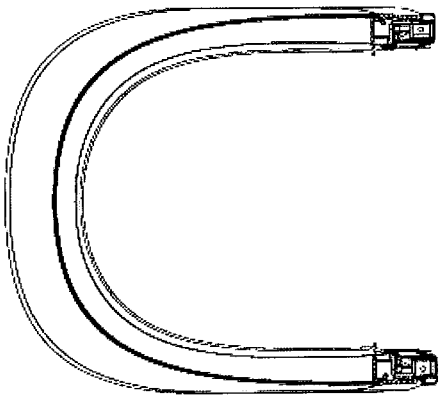
FIG. 8 is a section view of the furnace door of FIG. 6 along the direction of A-A.
Figure 9:
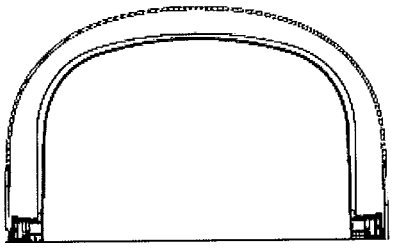
FIG. 9 is a section view of the furnace door of FIG. 6 along the direction of B-B.

See FIG. 3, the embodiment is different from the first embodiment that the operation/display unit 4 is provided on a facade of the bottom portion 5, others are the same as the first embodiment.

The embodiments are chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An arc-shaped microwave oven, comprising a cooking cavity (1), an oven base, a microwave generation unit (2) disposed within the oven base, and a control unit (3) also disposed within the oven base, wherein the oven base comprises a bottom portion (5) and a back portion (6) which is assembled with the bottom portion (5), the cooking cavity is formed by a cavity surrounded by the bottom portion, the back portion and a furnace door (7), the furnace door is in a hood shape and provided with a microwave shielding means, and the microwave generation unit and the control unit are electrically connected to an operation/display unit (4); wherein the furnace door (7) comprises an external cover (71), a microwave shielding cover (72), an inner cover (73) and a framework (74), sequentially arranged from external to internal, wherein the framework (74) comprises a first framework component (741) and a second framework component (742), the first framework component (741) and the second framework component (742) are connected at an angle to each other, the external cover (71), the microwave shielding cover (72) and the inner cover (73) are assembled together by the framework (74), and the framework (74) is provided with a choke groove (75); and wherein the inner cover (73) is provided with a raised edge (731, 731') which is embedded in an assembling slot (743) of the framework (74) and/or crimping contacts with an assembling edge (744) of the framework (74) so as to connect the inner cover (73) to the framework (74).

2. The arc-shaped microwave oven of claim 1, wherein the furnace door (7) is movably connected to the back portion (6), the furnace door swings up and down relative to the bottom portion (5) and the back portion to open and close respectively, and the furnace door is in an arc hood shape.

3. The arc-shaped microwave oven of claim 1, wherein the first framework component (741) and the second framework component (742) are formed integrally or separately, and the first framework component (741) and the second framework component (742) are U shaped, arch shaped, semi-circular shaped or elliptical shaped.

4. The arc-shaped microwave oven of claim 1, wherein the microwave shielding cover (72) is provided with flanges (721, 721'), the flange (721) crimping contacts with the first framework component (771) through a first crimp ring (741), and the flange (721') crimping contacts with the second framework component (742) through a second crimp ring (772).

5. The arc-shaped microwave oven of claim 4, wherein the microwave shielding cover (72) is in a helmet shape and has a cross-section in U shape, arch shape, semi-circular shape or elliptical shape, the shapes of the external cover and the inner cover match the shape of the microwave shielding cover (72), and the surface of the microwave shielding cover (72) is provided with several apertures that are hexagonal.

6. The arc-shaped microwave oven of claim 1, wherein the external cover (71) is sleeved on the framework (74) and provided with a view window (711).

7. The arc-shaped microwave oven of claim 6, wherein the view window (711) is provided with a frame which is enchased on the outside of the view window (711).

8. The arc-shaped microwave oven of claim 6, wherein the external cover (71) is connected with a decorative cover (78) which is located behind the external cover (71); and/or the external cover (71) is also connected with a decorative board (79) which is located beneath the external cover (71).

9. The arc-shaped microwave oven of claim 8, wherein the decorative cover (78) and/or decorative board (79) are provided with buckles which are connected with retainers provided on the framework (74), and the external cover (71) is clamped and fastened on the framework (74) through the decorative cover (78) and/or decorative board (79).

10. The arc-shaped microwave oven of claim 1, wherein the bottom portion (5) comprises a bottom cover (51) and a bottom board (52) horizontally arranged on top of the bottom cover, the back portion (6) is arranged at the rear end of the bottom portion (5) and comprises a back board (61) and a back cover (62), the back board is vertically positioned on the bottom board, and the back cover is arranged on the bottom portion and buckled with the back board.

11. The arc-shaped microwave oven of claim 1, wherein each of the bottom portion (5) and the back portion (6) is a rectangular with rounded corners, and the furnace door (7) is in a helmet shape.

12. The arc-shaped microwave oven of claim 1, wherein the microwave generation unit (2) and the control unit (3) are arranged inside the bottom portion (5), or, the microwave generation unit and the control unit are arranged inside the back portion, or, the microwave generation unit and the control unit are arranged inside the bottom portion and the back portion respectively.

13. The arc-shaped microwave oven of claim 1, wherein the operation/display unit (4) is provided on a facade of the bottom portion (5).

14. The arc-shaped microwave oven of claim 1, wherein a boss or bulge (53) extended outwards is provided at the front end or peripheral of the bottom portion (5), and the operation/display unit (4) is provided on the boss or bulge.

15. The arc-shaped microwave oven of claim 1, wherein the operation/display unit (4) is provided on the furnace door (7).

* * * * *